United States Patent [19]

Levitt

[11] 4,038,697

[45] Aug. 2, 1977

[54] SHEET-AND-BIB COMBINATION

[76] Inventor: Sylvia Levitt, 16 Sutton Place, New York, N.Y. 10022

[21] Appl. No.: 726,535

[22] Filed: Sept. 27, 1976

[51] Int. Cl.[2] ..... A41B 13/10

[52] U.S. Cl. ..... 2/49 A; 5/335; 2/69

[58] Field of Search ..... 2/49 A, 69, 49 R, 46; 5/335

[56] References Cited

U.S. PATENT DOCUMENTS

| | | | |
|---|---|---|---|
| 2,594,053 | 4/1952 | McKewen | 2/49 A X |
| 2,616,085 | 11/1952 | Bottolfsen | 2/49 A X |
| 2,672,614 | 3/1954 | Zimmerman et al. | 2/49 A X |
| 2,822,548 | 2/1958 | Rhowmine | 2/49 A |
| 3,079,611 | 5/1963 | Boryszewski | 2/69 X |
| 3,146,464 | 9/1964 | Burnett | 2/49 R |
| 3,665,518 | 5/1972 | Leadford | 2/49 R X |

FOREIGN PATENT DOCUMENTS

| | | | |
|---|---|---|---|
| 632,965 | 10/1963 | Belgium | 5/335 |

*Primary Examiner*—Alfred R. Guest
*Attorney, Agent, or Firm*—Joel Halpern

[57] ABSTRACT

A sheet-and-bib combination includes a sheet of water-repellant material of sufficient size to cover a standard size hospital bed which is provided with a longitudinally extending central adhesive strip. A disposable bib is secured to said strip of adhesive material by means of a cooperable like adhesive strip and extends upwardly from the sheet material.

6 Claims, 2 Drawing Figures

SHEET-AND-BIB COMBINATION

BACKGROUND OF THE INVENTION

The present invention relates to a sheet-and-bib combination.

Poncho-type garments have been known heretofore and have been used primarily for sports wear and other casual dress. U.S. Pat. No. 3,079,611 issued Mar. 5, 1963 to Boryszewski, for example, discloses a beach toga of the poncho-type wherein a pair of terrycloth towels are provided on their inner edges with cooperable male and female snap elements and through proper manipulation permit the garment to be used as a dressing robe. U.S. Pat. No. 3,665,518 issued May 30, 1972 to John L. Leadford discloses a disposable rain poncho formed of a thin plastic material.

Heretofore, various types of dressing gowns have been employed by bed-ridden persons in lieu of everyday clothing partially for reasons of comfort, convenience and cleanliness. Such persons infrequently leave the bed and, therefore, customarily eat their meals in bed. This leads generally to a situation where both the dressing gown and the bed covers become soiled and dampened by food and beverages to the extent that the dressing gown and/or the bedding require replacement in order to alleviate the discomfort of the bed-ridden person or to avoid the creation of unsanitary conditions. The constant replacement of such gowns and bed covers, however, constitutes a substantial expense and involves also time-consuming operations. Where the person is confined to a hospital this places an additional burden on the staff.

SUMMARY OF THE INVENTION

It is a principal object of the invention to provide a sheet-and-bib combination for bed-ridden persons which can be worn for longer periods of time because of their capability of being maintained in clean and dry condition.

Another object of the invention is to provide a bib device for bed-ridden persons which minimizes replacement of same and of the bed covering in beds occupied by such persons.

Other objects and advantages of the invention will become readily apparent from the following description of the invention.

According to the present invention there is provided a sheet-and-bid comprising in combination: a sheet of waterrepellent material having a slot formed ⅓ from one edge thereof of sufficient width to permit the passage therethrough of a person's head and shoulders; a strip of adhesive material provided on the sheet extending longitudinally thereof at approximately the center thereof, and a bib of disposable material positioned in upwardly projecting relationship to the sheet material and detachably adhered thereto by means of an adhesive strip extending along substantially the longitudinal center line thereof in mating engagement with the strip of adhesive material on said sheet.

BRIEF DESCRIPTION OF THE DRAWINGS

In order that the invention may be more fully understood it will now be described, by way of example, with reference to the accompanying drawings, in which.

DETAILED DESCRIPTION OF THE INVENTION

Figure 1:
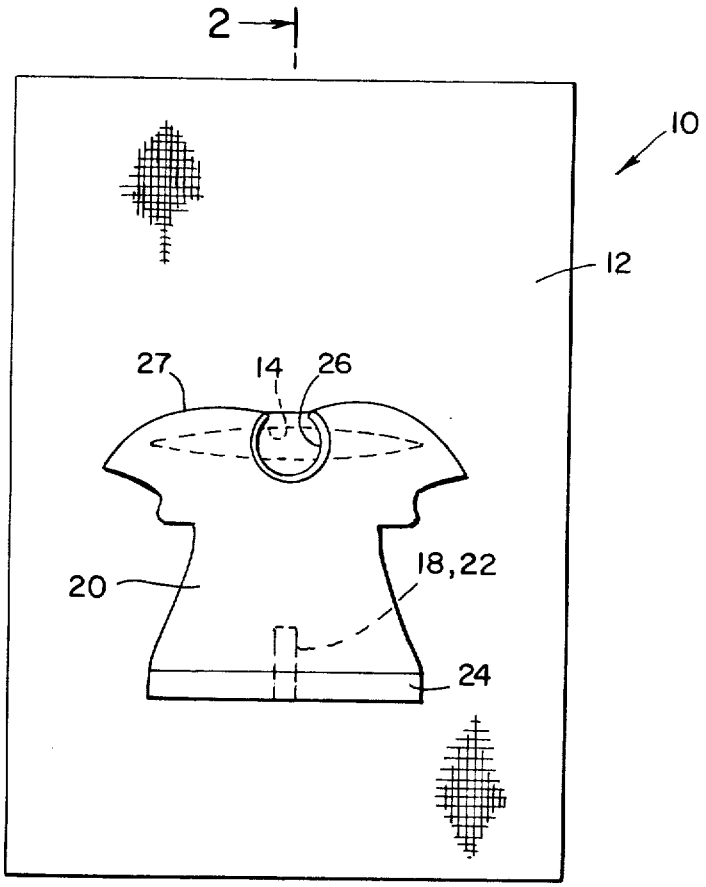
FIG. 1 is a plan view of a sheet-and-bib which incorporates the invention.

Referring to the drawings there is shown generally a sheet-and-bib 10. The combination includes a body or sheet of water-repellent material 12 preferably of rectangular shape as shown in FIG. 1. A slot 14 is formed ⅓ down from one edge of the sheet, the slot being desirably laterally extending. The slot is, of course, given a sufficient length to permit the passage therethrough of the head and shoulders of a person to enable the sheet to be slipped over the person's head and shoulders so as to rest on the bed. The sheet material 12 is desirably of sufficient longitudinal and lateral dimensions to cover pillows and blankets and the upper surface of a standard size hospital bed.

Figure 2:
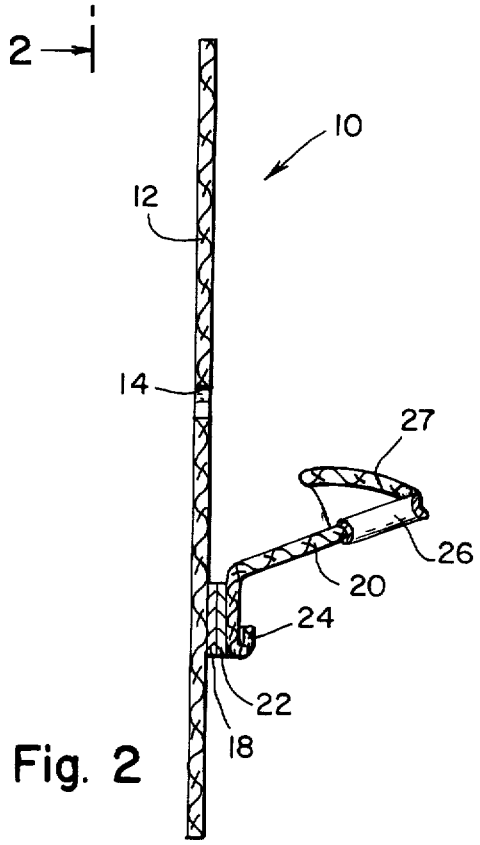
FIG. 2 is a side view, in cross-section, taken along line 2—2 of FIG. 1.

A strip of adhesive material 18 is provided on the sheet material and extends longitudinally along the center line thereof for a short distance. As can be seen most clearly from FIG. 2 the length of the strip 18 is only sufficient to effect the securing of the bib to the sheet so as to enable the bib to project outwardly of the sheet in a direction substantially normal thereto. The extent of the strip is selected to be substantially coextensive with the length of a mating strip 22 provided on disposable bib 20 to be placed in partially overlying relation to the sheet material as described hereinafter.

A bib 20 of disposable material, preferably a cellulose material is secured to the adhesive strip 18 so that it partially overlies the sheet material 12 as shown in the drawings. The bib may be imprinted or embossed with an attractive pattern if so desired. A cooperable strip 22 of adhesive material similar to that of strip 18 is provided on the inner surface of the bib the center line thereof such that when the bib is positioned in place to be worn the adhesive strip of the bib will be superimposed over the adhesive strip of the sheet material to afford an adhesive coupling action. It will be understood, of course, that bib 20 is given a length approximately equivalent to the lap of a person's torso. The center portion of the bib may be shaped to provide a curved neck 26 in the vicinity of the slot 14 when in place on the person to offer greater comfort for the wearer. The shoulder portion 27 may desirably be flared to afford maximum protection for the person's shoulder area. A laterally extending pocket 24 is formed on the bib 20 and its lateral dimension is desirably as great as the width of the disposable bib 20.

The adhesive strips 18 and 22 are preferably strips of VELCRO which is a readily available material. The strips may be stitched or otherwise secured to the sheet material.

From the foregoing it will be seen that a sheet-and-bib has been provided for a bed-ridden person which is simple, includes a bib section which is detachable secured to an adhesive strip provided on the sheet, the sheet being of such size that the bed covers are protected against being dampened or soiled by liquids and solid foods served to the person in bed at mealtimes. The device of the invention thus offers reduced costs in connection with the maintenance of the person while concomitantly affording improved comfort and sanitary conditions.

I claim:

1. A sheet-and-bib device comprising in combination:

a sheet of water-repellent material having a slot formed approximately ⅓ sheet length from one edge thereof of sufficient length to permit the passage therethrough of a person's head and shoulders;

a strip of adhesive material provided on said sheet extending longitudinally thereof at approximately the center of the width thereof; and a bib of disposable material positioned in outwardly extending relationship to said sheet material and detachably adhered thereto by means of an adhesive strip extending along substantially the longitudinal center line thereof in mating engagement with the strip of adhesive material on said sheet.

2. A bib device according to claim 1, including a laterally extending pocket adjacent the edge thereof secured to said sheet.

3. A bib device according to claim 1, wherein said sheet material is of rectangular shape and is of sufficient longitudinal and lateral dimensions to substantially cover a standard size hospital bed.

4. A bib device according to claim 1, wherein said strips of adhesive material are strips of VELCRO.

5. A bib device according to claim 1 wherein said slot extends laterally of said sheet and said strip of adhesive material on said sheet extends from a location intermediate said slot and the other edge of the sheet and is substantially coextensive with the length of the adhesive strip on said bib.

6. A bib device according to claim 1, wherein the upper central portion of said bib is configured to provide a curved neck portion.

* * * * *